US007556025B2

(12) United States Patent
Sotiriades

(10) Patent No.: US 7,556,025 B2
(45) Date of Patent: Jul. 7, 2009

(54) EVAPORATIVE EMISSION CONTROL APPARATUS AND METHOD

(75) Inventor: Aleko D. Sotiriades, Cedarburg, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 11/676,605

(22) Filed: Feb. 20, 2007

(65) Prior Publication Data

US 2008/0196698 A1 Aug. 21, 2008

(51) Int. Cl.
*F02M 37/02* (2006.01)
*F02M 37/00* (2006.01)

(52) U.S. Cl. ..... 123/516; 123/517

(58) Field of Classification Search ..... 123/516, 123/518, 519, 520, 198 D, 509, 517; 261/36.2, 261/50.1, DIG. 67
See application file for complete search history.

(56) References Cited

U.S. PATENT DOCUMENTS 3,039,124 A * 6/1962 Houser et al. ..... 15/79.1
3,048,157 A 8/1962 Gregory et al.
3,517,654 A 6/1970 Sarto et al.
3,540,423 A * 11/1970 Tolles ..... 123/519
3,540,701 A 11/1970 Brenneke et al.
3,548,797 A * 12/1970 Hagihara et al. ..... 123/519
3,575,152 A * 4/1971 Wentworth ..... 123/520
3,640,257 A 2/1972 Cornelius
3,673,997 A 7/1972 Sawada
3,675,634 A 7/1972 Tatsutomi
3,690,305 A * 9/1972 Shimada et al. ..... 123/325
3,695,376 A 10/1972 Fiedler et al.
3,779,224 A 12/1973 Tagawa et al.
4,076,770 A * 2/1978 Saito et al. ..... 261/34.2
4,178,894 A 12/1979 Nau
4,193,383 A 3/1980 Rogers
4,203,401 A 5/1980 Kingsley et al.
4,741,317 A 5/1988 Yost
5,056,493 A 10/1991 Holzer
5,148,793 A * 9/1992 Reddy ..... 123/520
5,184,591 A 2/1993 Sausner et al.
5,203,306 A 4/1993 Billingsley et al.
5,408,977 A * 4/1995 Cotton ..... 123/520

(Continued)

FOREIGN PATENT DOCUMENTS

EP 1607613 A2 12/2005

(Continued)

*Primary Examiner*—Mahmoud Gimie
(74) *Attorney, Agent, or Firm*—Whyte Hirschboeck Dudek SC

(57) ABSTRACT

A system of mechanical components that operate cooperatively to control evaporation of fuel or hydrocarbon leakage from engines is disclosed. In at least some embodiments, the system of mechanical components comprises a first valve assembly and a second valve assembly. The first valve assembly, which functions as a fuel-shut off valve assembly, governs whether fuel can proceed from a fuel bowl into a carburetor, and when closed, prevents fuel vapors from developing within the carburetor. The second valve assembly, which functions as a "vapor venting control valve assembly," has an input port that is coupled by way of a fuel tank vapor hose to both a fuel tank and to the fuel bowl. When in a closed state, the second valve assembly controls the fuel vapors, which are provided to its input port from the fuel tank and the fuel bowl, from being communicated to an output port of the second valve assembly.

30 Claims, 5 Drawing Sheets

U.S. PATENT DOCUMENTS

| | | | | |
|---|---|---|---|---|
| 5,460,143 | A * | 10/1995 | Narita | 123/520 |
| 6,450,152 | B1 | 9/2002 | Everingham | |
| 7,047,951 | B2 * | 5/2006 | Rado | 123/518 |
| 2004/0123846 | A1 * | 7/2004 | Rado et al. | 123/525 |
| 2007/0006852 | A1 | 1/2007 | Schondorf | |
| 2007/0079814 | A1 | 4/2007 | Rado et al. | |

FOREIGN PATENT DOCUMENTS

| | | | |
|---|---|---|---|
| GB | 1167973 | A | 10/1969 |

* cited by examiner

EVAPORATIVE EMISSION CONTROL APPARATUS AND METHOD

CROSS-REFERENCE TO RELATED APPLICATIONS

STATEMENT REGARDING FEDERALLY SPONSORED RESEARCH OR DEVELOPMENT

FIELD OF THE INVENTION

The present invention relates to internal combustion engines and, more particularly, to apparatuses and methods for controlling or restricting evaporative emissions from such engines.

BACKGROUND OF THE INVENTION

Internal combustion engines are used in a wide variety of applications. As a result of the internal combustion process, and the need for fuels to perform that process, such engines necessarily generate emissions having a variety of carbon-based and other substances. Increasingly, it is desired that internal combustion engines operate in a manner such that at least one or more components of these emissions be reduced or eliminated.

Further, small engine manufacturers are subject to both exhaust and evaporative emissions regulations by the Environmental Protection Agency (EPA) and California Air Resource Board (CARB) commencing with engines produced for the 2006 model year. The emissions limitations set by these agencies will become more stringent with each successive year and are expected to plateau in the year 2009. Hydrocarbon molecule concentration is the primary component measured by the EPA and CARB.

A major source of hydrocarbon emissions from internal combustion engines is evaporated fuel emanating from plastic fuel tanks, which are typically made from high density polyethylene (HDPE), polypropylene, polyamide (PA) or other low cost materials, as well as fuel tank caps. An additional source of evaporative emissions is evaporated fuel emanating from carburetors.

One approach being adopted by the small engine industry to reduce such evaporative emissions is to employ the use of a carbon canister (CC) as a temporary repository of fuel vapors produced by the fuel tank, the carburetor fuel bowl or a combination of the two when the engine is not functioning. At some time upon start-up of the engine, the CC is purged of the stored vapor. This type of control system is commonly referred to as an "open system design."

There are typically two types of control valves associated with a CC. The first type of valve is known as a roll-over valve (ROV). Most commonly, a ROV couples the CC to the fuel tank, and functions to allow vapor to vent only from the fuel tank. The ROV must prevent liquid from entering the CC or it will be rendered useless. In some systems, there is an additional ROV by which the CC is attached to the carburetor fuel bowl vent. The second type of valve is known as a purge valve (PV), and functions to control vapor flow from the CC into the main induction line of the carburetor to the engine. The PV is controlled by engine manifold operation, venturi vacuum operation, or a combination of the two processes.

Although the open system design does provide some control over evaporative emissions, such a system has several disadvantages. First, the CC can be damaged from excessive engine vibration. Second, the CC can be rendered useless if liquid fuel enters the carbon chamber. Third, it can be difficult to locate the components of an open system design such that the components are not damaged from interaction or friction with other engine components. Fourth, when the system contains only one ROV, hydrocarbon emission from the carburetor is not accounted for and can potentially be released, thereby resulting in undesirably high emissions (such as could result in an emission level test failure). The addition of a second ROV to the carburetor can potentially help to reduce this problem but can be costly.

Therefore, it would be advantageous if an improved system (or systems) could be developed for reducing hydrocarbon leakage or evaporation of fuel (or potentially other emissions) into the surrounding environment from internal combustion engines including, for example, small engines. In at least some embodiments, it would be advantageous if such an improved system was capable of reducing the amount of fuel vapor escaping from several engine components including, for example, the carburetor, the carburetor fuel supply hose, vacuum hoses, the fuel tank and/or the fuel tank filler cap.

BRIEF SUMMARY OF THE INVENTION

In at least some embodiments, the present invention relates to an emission control apparatus for an engine that includes a first valve assembly that regulates a first flow of fuel from a fuel bowl into a carburetor, a second valve assembly that regulates a second flow of fuel vapors from a fuel bowl and a fuel tank into a region upstream of an engine cylinder, and an actuator that controls opening and closing of said first valve assembly and said second valve assembly.

Further, in at least some embodiments, the present invention relates to an engine that includes (a) a carburetor; (b) a fuel bowl supported in relation to the carburetor; (c) a fuel tank coupled to the fuel bowl; and (d) a first valve assembly, where the first valve assembly comprises an input port coupled to the fuel tank and the fuel bowl to receive vapors therefrom. Also, the engine includes; (e) a second valve assembly, where the second valve assembly regulates a flow of fuel from the fuel bowl into the carburetor, and (f) an actuator coupled at least indirectly to each of the first and second valve assemblies, whereby opening and closing of the first valve assembly and second valve assembly is regulated.

Additionally, in at least some embodiments, the present invention relates to a method for reducing emissions from an engine. The method includes providing an assembly including a fuel tank, a carburetor, a fuel bowl coupled to the fuel tank and the carburetor, a first valve assembly coupling the fuel bowl with the carburetor and governing a first flow of fuel from the fuel bowl to the carburetor, and a second valve assembly coupling at least one of the fuel tank and the fuel bowl to a region upstream of a cylinder. The method further includes opening the second valve assembly to allow a first flow of fuel vapors from the at least one fuel bowl and fuel tank into the region, and subsequently opening the first valve assembly to allow a second flow of fuel from the fuel bowl into the carburetor.

Further, in at least some embodiments, the present invention provides a method by which, when first and second valve assemblies are both closed, evaporative emissions from the carburetor, the fuel bowl and the fuel tank are substantially prevented. Also, in at least some embodiments, the present invention relates to a method by which, when first and second valve assemblies are both closed, a rapidity with which the fuel within the fuel tank becomes stale is reduced.

DETAILED DESCRIPTION OF THE PREFERRED EMBODIMENT

The present invention relates to a variety of embodiments of systems and related methods of operation of mechanical components for reducing evaporation of fuel or hydrocarbon leakage into the environment from a variety of different internal combustion engines including, for example, gasoline or diesel engines. Although several specific embodiments are described below with reference to the FIGS., it should be understood that the present invention is intended to encompass a variety of other embodiments of mechanical components and related parts other than (or in combination with) the particular systems and components that are shown and described with reference to the FIGS.

Also, while the systems of mechanical components to reduce evaporation or hydrocarbon leakage of fuel to the surrounding atmosphere encompassed within the present invention are intended to be applicable to a wide variety of engines, in particular, the described invention is intended to be applicable to Class 1 and Class 2 small off-road engines such as those implemented in various machinery and vehicles, including, for example, lawn mowers, snow mobiles and the like. In at least some such embodiments, the present invention is intended to be applicable to "non-road engines" as defined in 40 C.F.R. §90.3, which states in pertinent part as follows: "Non-road engine means . . . any internal combustion engine: (i) in or on a piece of equipment that is self-propelled or serves a dual purpose by both propelling itself and performing another function (such as garden tractors, off-highway mobile cranes, and bulldozers); or (ii) in or on a piece of equipment that is intended to be propelled while performing its function (such as lawnmowers and string trimmers); or (iii) that, by itself or in or on a piece of equipment, is portable or transportable, meaning designed to be and capable of being carried or moved from one location to another. Indicia of transportability include, but are not limited to, wheels, skids, carrying handles, dolly, trailer, or platform."

Further, at least some additional embodiments, the present invention applies to engines that have less than one liter in displacement, or engines that both have less than one liter in displacement and fit within the guidelines specified by the above-mentioned regulations. In still further embodiments, the present invention is intended to encompass other small engines, large spark ignition (LSI) engines, and/or other larger (mid-size or even large) engines. In at least some embodiments, the present invention applies to a v-twin engine.

Figure 1:
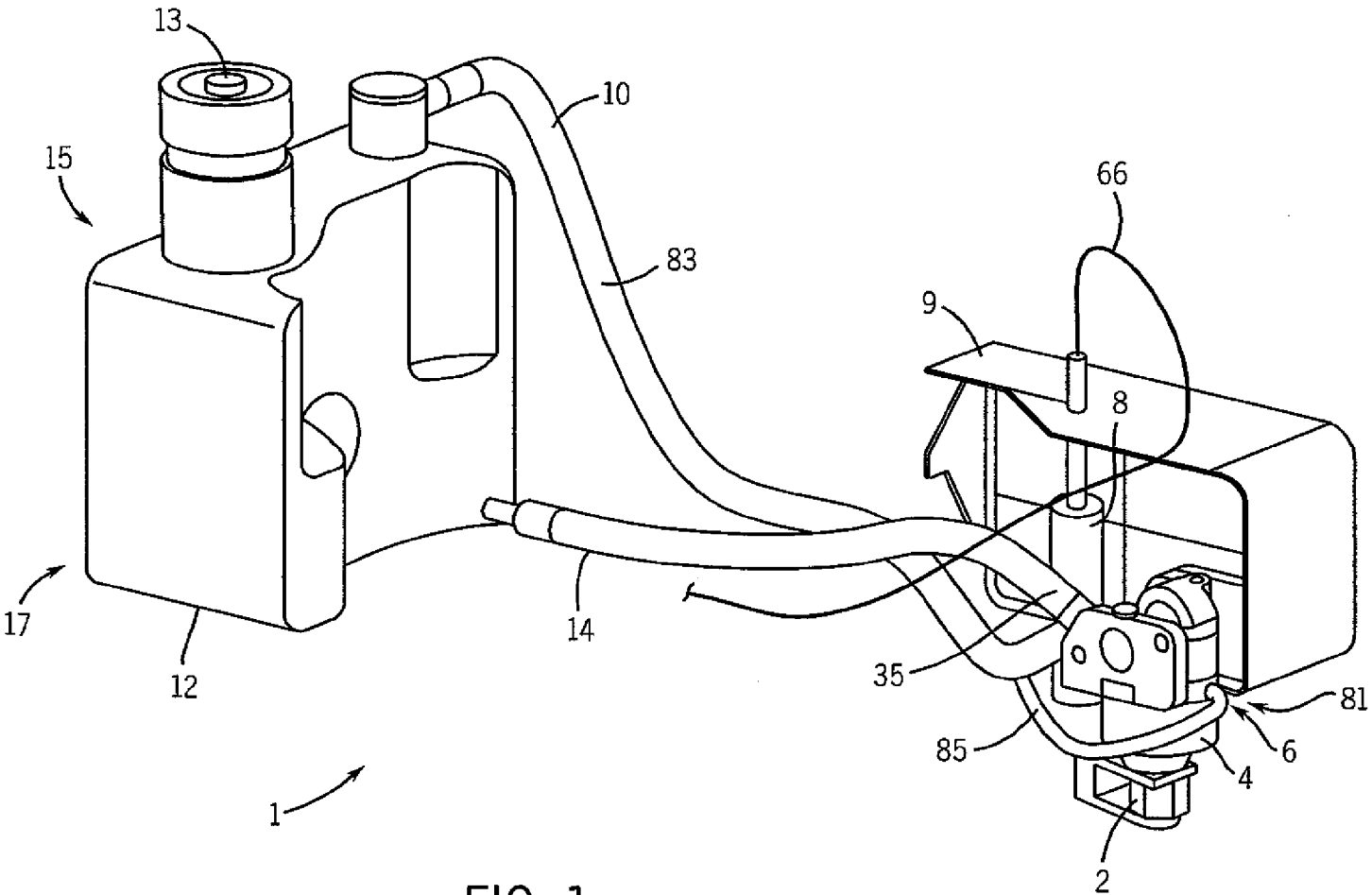
FIG. 1 is a perspective view of components of an evaporative emission control system for an internal combustion engine in accordance with at least one embodiment of the present invention.

Referring to FIG. 1, a perspective view of an evaporative emissions control system 1 for an internal combustion engine in accordance with at least one embodiment of the present invention is provided. As shown, the system 1 includes two valve assemblies, namely, a first valve assembly 2, which functions as a fuel shut-off valve assembly, and a second valve assembly 8, which functions as a vapor venting control valve assembly. Further as shown, the first valve assembly 2 is supported upon (and within) a fuel bowl 4, which in turn is positioned beneath a carburetor 6, while the second valve assembly 8 is supported upon an air filter housing (or air cleaner assembly or airbox) 9.

Figure 4:
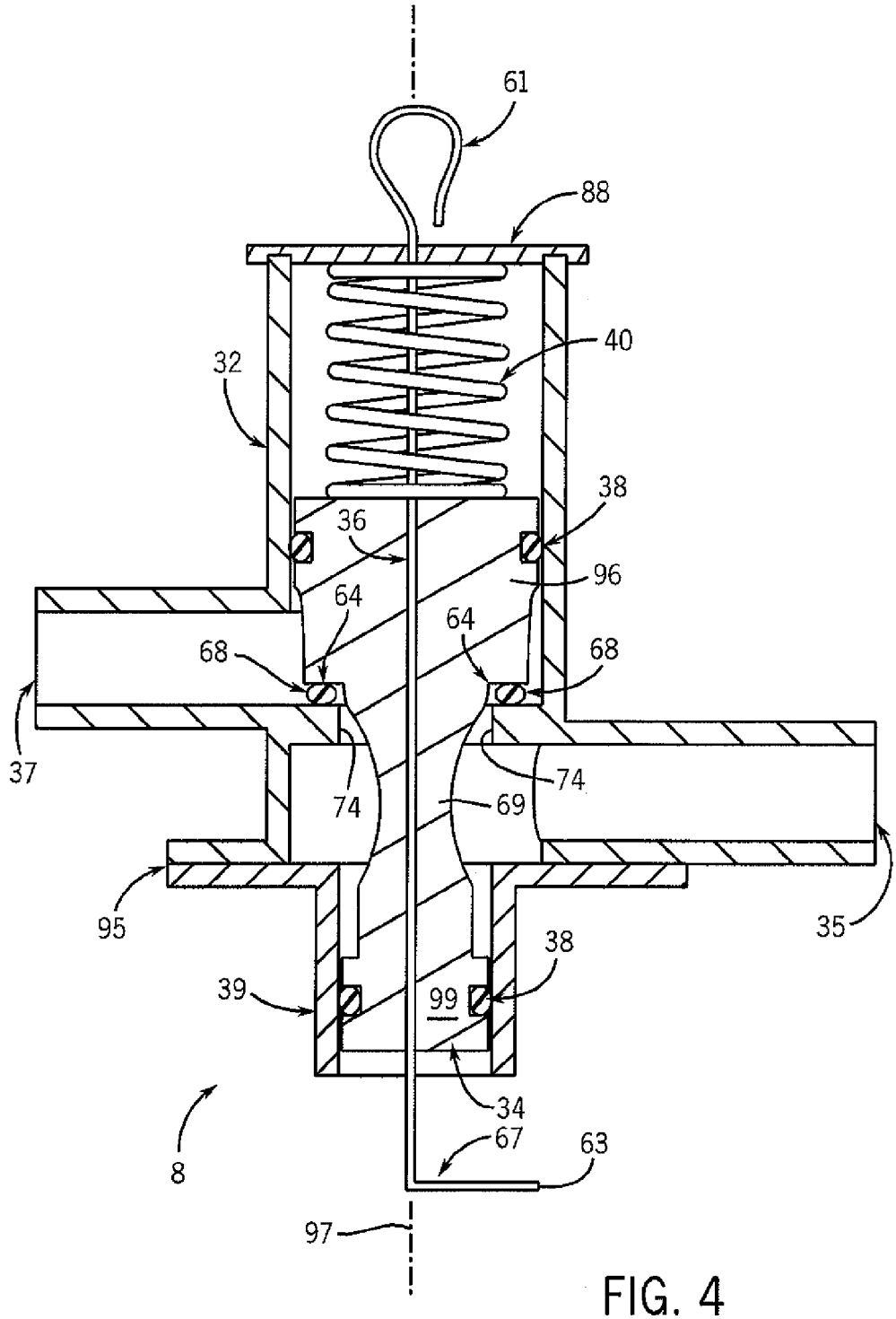
FIG. 4 is a schematic, partially cross-sectional diagram of the second valve assembly of FIG. 2.

The second valve assembly 8 has an input port 35 (which is partially hidden in FIG. 1, but also shown in FIG. 4) and an output port 37 (see FIG. 4). The input port 35 is connected by way of a fuel tank vapor hose 10 to both a fuel tank 12 and to a fuel bowl vapor exit port 81 of the fuel bowl 4. The output port 37 is connected directly to the air filter housing 9 (particularly to a region within the air filter housing that is in communication with the carburetor and is downstream of an air filter within the air filter housing), such that the output of the second valve assembly 8 is directly provided to the engine for combustion. In alternate embodiments, the output port 37 can be coupled to a blower housing or an intake manifold, rather than to an airbox/air filter housing/air cleaner assembly.

As shown in FIG. 1, the fuel tank vapor hose 10 actually is a y-shaped hose structure having a main section 83 coupling the input port 35 of the second valve assembly 8 with the fuel tank 12 and a secondary section 85 coupling the main section to the exit port 81 of the fuel bowl 4. Additionally, the fuel tank 12 and the exit port 81 of the fuel bowl 4 also are coupled by way of an engine fuel supply line 14 so as to allow file to be delivered from the fuel tank to the fuel bowl.

As shown, the fuel tank 12 includes a fuel cap 13 at a top (or upper) surface 15. The fuel tank vapor hose 10 also is coupled to the fuel tank 12 proximate to the top surface 15, since that is where vapors tend to collect, while the supply line 14 is coupled proximate a bottom surface 17 of the fuel tank. In an alternative embodiment, a first fuel tank vapor hose can be used to couple the input port 35 with the fuel tank 12 and a second fuel tank vapor hose can be used to couple the fuel tank to the exit port 81 of the fuel bowl 4.

The fuel tank 12, fuel cap 13, fuel tank vapor hose 10, and engine fuel supply line 14 all are preferably manufactured from materials that are non-permeable with respect to hydrocarbon/fuel vapors. Low permeation materials that can be utilized for these structures (and particularly for the fuel tank) depending upon the embodiment can include, for example, injection molded (single-layer) materials such as polyphthalamide (PPA), compounded blends of polycarbonate and polybutylene terephthalate (PC+PBT), or polyphenylene sulfide (PPS). Multi-layer (e.g., blow, roto or hot plate twin sheet molded) materials such as EVOH (ethylene vinyl alcohol copolymer) sandwiched between HDPE (high density polyethylene) or PP (polypropylene) can also be employed. Additionally for example, an overmold process involving 2-injection molded materials can be employed (for example, where an inexpensive material such as polyamide (PA) is molded over a thin PPS shell).

Figure 2:
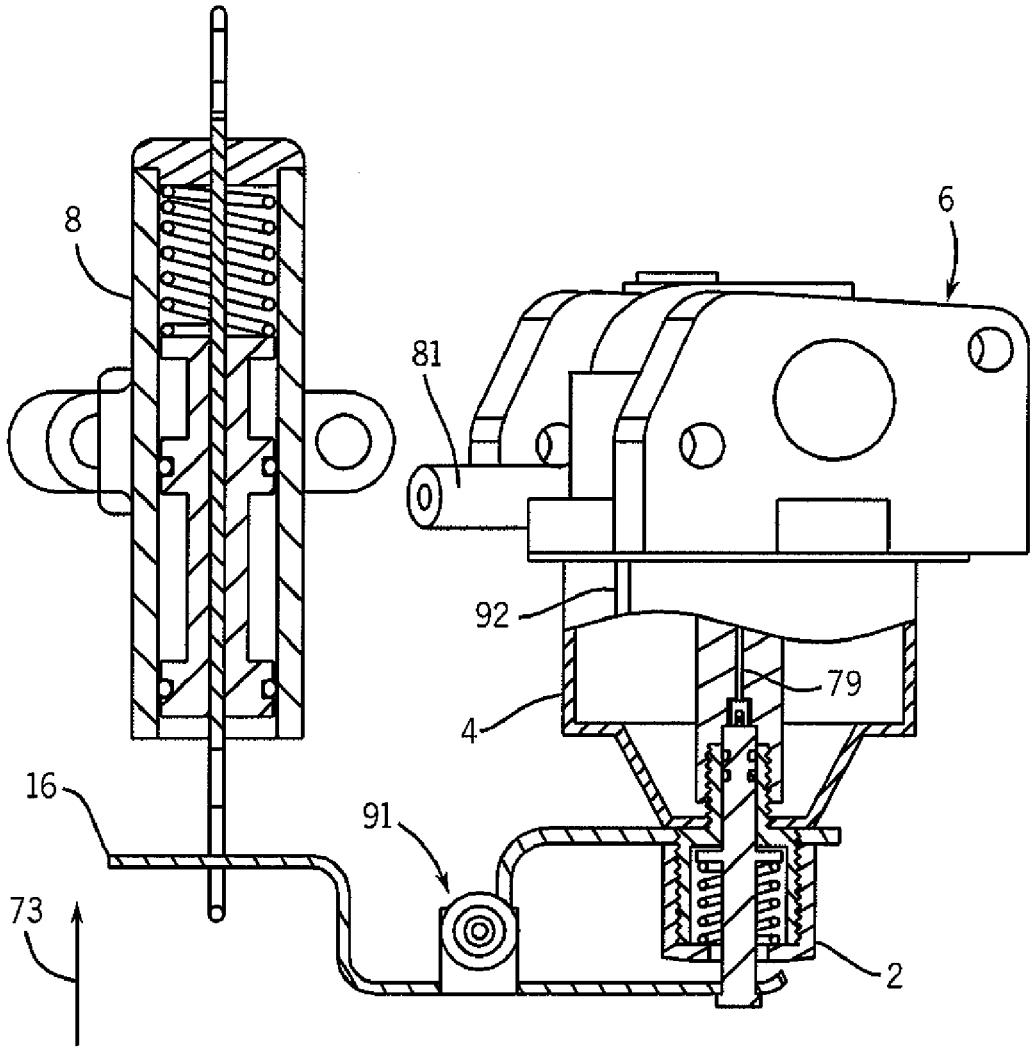
FIG. 2 is a schematic, partially cross-sectional diagram depicting the connections among a first valve assembly, which functions as a fuel shut-off valve assembly, a second valve assembly, which functions as a vapor venting valve assembly, and an actuator, which controls the opening and closing of the valve assemblies, all of which are part of the control system of FIG. 1.

Referring to FIG. 2, a partial cross-sectional schematic view is provided showing in further detail certain components of the evaporative emissions control system 1. As shown, both of the first and second valve assemblies 2 and 8 (the latter of which is again shown mounted with respect to the fuel bowl 4 and carburetor 6) are coupled to, and actuated by, a handle 16. The handle 16 can be an operator-actuated handle or, in at least some embodiments, can be automatically actuated. The handle 16 in some embodiments can be replaced with other types of actuators, e.g., a knob. In at least some embodiments, the handle 16 or other actuator can be controlled by a controller or even a remote (e.g., wireless remote) control device, and/or can be motor driven. In the present embodiment, the handle 16 not only governs the opening/closing of the valve assemblies 2, 8 but also controls the operation of the engine with which the present evaporative emissions control system 1 is implemented, e.g., turns the engine "on" or "off." In at least some embodiments, the handle that governs the opening/closing of the valve assemblies 2, 8 can be a distinct handle that is different and separate from the handle (or other actuator) that controls the operation of the engine.

FIG. 2 in particular shows the handle 16 to be a lever that pivots around a fulcrum 91. The particular position of the handle 16 shown is an "off" position, such that both of the first and second valve assemblies 2, 8 are in closed positions. In particular with respect to the first valve assembly 2, that valve assembly serves to control the provision of fuel from the fuel bowl 4 into the carburetor 6. When closed, the first valve assembly 2 serves to plug a carburetor fuel supply passage 79 linking the fuel bowl 4 with the carburetor 6, and thereby prevents fuel vapors from developing within the carburetor 6 that might escape into the environment. At this time, vapors from the fuel bowl 4 are communicated to the fuel tank vapor hose 10 by way of the exit port 81, which is coupled to the fuel bowl by way of a fuel bowl vapor port 92.

As for the second valve assembly 8, that valve assembly serves to control the provision of hydrocarbon or fuel vapors at the input port 35, which are from the fuel tank 12 and the fuel bowl 4, to the output port 37. When the handle 16 is in the "off" position, the second valve assembly 8 is closed, such that hydrocarbon/fuel vapors are prevented from escaping from the fuel tank 12 or fuel bowl 4 to the atmosphere via the airbox/air filter housing 9 (or otherwise).

In contrast, as the handle 16 is moved along a direction indicated by an arrow 73 toward an "on" position, which in the present embodiment also results in the engine being turned on, the second valve assembly 8 is opened partly. While the input port 35 of the second valve assembly 8 is connected to the fuel tank 12 and the fuel bowl 4, the output port 37 of that assembly is coupled to the air filter housing 9 (as mentioned above, particularly downstream of the air filter) of the engine, which can be located along the intake of the engine such as between the air filter and the carburetor 6. Thus, when the second valve assembly 8 is opened, fuel vapors and excess pressure buildup within the fuel tank 12, fuel bowl 4 and fuel tank vapor hose 10 is discharged to the airbox and the engine intake.

As the handle 16 continues to be opened further along the direction of the arrow 73, the second valve assembly 8 allows for a continued connection between the fuel tank 12, fuel bowl 4 and the airbox, and additionally the first valve assembly 2 is opened so as to allow fuel from the fuel bowl 4 to enter the carburetor 6. Fuel is provided to the carburetor 6 due to the pressure differential between atmospheric pressure and the reduced pressure existing within the carburetor due to its venturi action. Additionally at this time, fumes arising from the fuel tank 12 and fuel bowl 4, including fumes that arose from the fuel tank 12 and fuel bowl 4 while the engine was off, are drawn into the engine by way of the intake rather than discharged into the atmosphere.

Given the above-described design, the present embodiment of the evaporative emissions control system 1 can be referred to as a "closed system design" insofar as it largely, if not entirely, eliminates the discharge of fuel and/or other hydrocarbon fumes to the atmosphere. More particularly, the emission of fuel fumes from the carburetor 6 when the engine is turned "off" is reduced since fuel is precluded from flowing from the fuel bowl 4 to the carburetor 6 at this time. Also, fuel fumes arising from the fuel tank 12 and the fuel bowl 4 are trapped by the second valve assembly 8 when the engine is off. By manufacturing the fuel tank 12 (including fuel cap 13), fuel bowl 4 and fuel tank vapor hose 10 out of materials that themselves are not permeable to hydrocarbon/fuel vapors, these vapors thus cannot escape to the atmosphere at this time. Additionally, because the system 1 prevents the release of fumes while the engine is off, the system also provides the added benefit of preventing the fuel remaining within the fuel tank 12 and fuel bowl 4 from becoming stale during long periods of engine inactivity.

The triggering of the second valve assembly 8 to open just when the engine is being turned on is advantageous insofar as the commencement of engine operation tends to create a vacuum pressure causing the hydrocarbon/fuel vapors within the fuel tank 12, fuel bowl 4 and fuel tank vapor hose 10 to be sucked into the engine via the second valve assembly. Additionally, the staggered opening of the second valve assembly 8 subsequent to the opening of the first valve assembly 2 in the above-described manner is desirable in that it reduces pressure buildup within the fuel tank 12 and the fuel bowl 4 prior to allowing fuel to flow into the carburetor 6. As a result, the likelihood that a premature and excessive injection of fuel into the carburetor 6 will occur upon opening of the first valve assembly 2 is reduced. In at least some alternate embodiments, the opening of the first and second valve assemblies 2, 8 is performed in an intermittent manner, a non-staggered manner, or in other manners.

Figure 3:
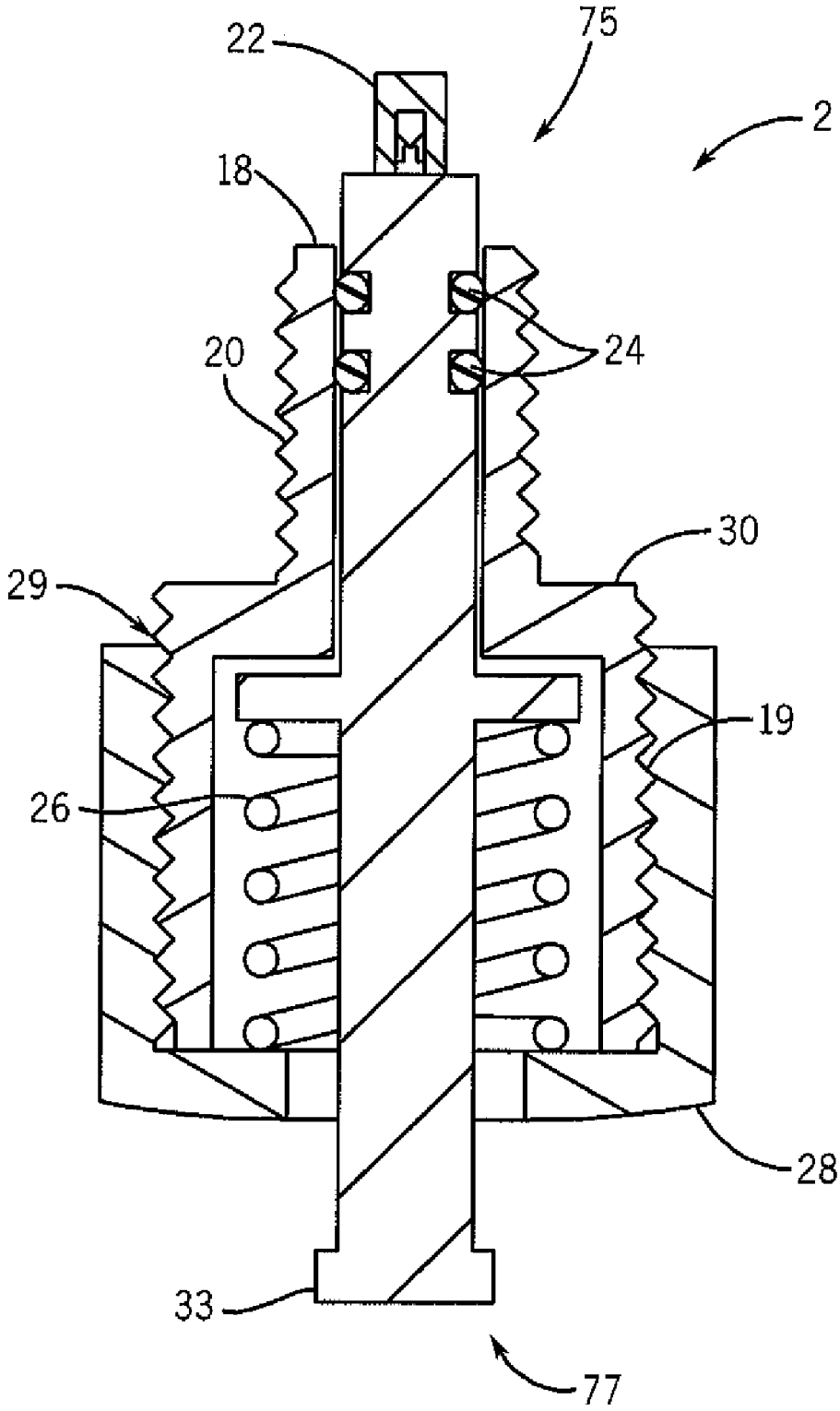
FIG. 3 is a schematic, partially cross-sectional diagram of the first valve assembly of FIG. 2.

Turning to FIG. 3, one exemplary embodiment of the first valve assembly 2 is shown in more detail. As shown, the first valve assembly 2 has first and second body portions 28 and 30. The first body portion 28 is cup-shaped and has an orifice 29 and internal threads 19 allowing the second body portion 30 to be screwed into the first body portion. The second body portion 30 in turn not only has complementary threads 19 by which it is coupled to the first body portion 28, but also has external threads 20 along a neck portion 18 protruding away from the first body portion. The threads 20 enable valve assembly 2 to be threaded directly into the body of the carburetor 6 and, in at least some embodiments, the valve assembly can simply replace a bolt (not shown) that otherwise would be employed to couple the fuel bowl 4 to the carburetor 6. The threads 19, 20 of the second body portion 30 can be made from material including but not limited to brass, stainless steel, zinc-plated formed steel, copper, bronze, cupronickel, aluminum bronze, phosphor bronze, or gunmetal. In at least some embodiments, the remainder of the second body portion 30 is made from brass or stainless steel. Likewise, the first body portion 28 can be made from any of the aforementioned materials suitable for body portion 30.

In addition to the body portions 28, 30, the first valve assembly 2 further includes a piston 33 that extends axially through both of the body portions. A first end 75 of the piston 33 that protrudes from the neck portion 18 of the first body portion includes a fuel-impervious overmolded fluorosilicone rubber plunger tip 22. Two valve body piston sealing O rings 24, which also are made from fuel impervious fluorosilicone rubber, seal between the internal surface of the neck portion 18 and piston 33 to prevent external leakage of the valve assembly. Further, the first valve assembly 2 includes a stainless steel (or brass) piston return spring 26.

When the engine is not running (e.g., the handle 16 is in the "off" position), the piston return spring 26 forces the piston 33 toward the neck portion 18 as shown, so as to force the piston tip 22 into the carburetor fuel supply passage 79 (see FIG. 2). This prevents fuel flow and the escaping of fumes from the fuel bowl 4 into the carburetor 6 and subsequently into the atmosphere. However, when the handle 16 is being actuated to the "on" position, the handle (which is coupled to a second end 77 of the piston 33 opposite the first end 75) causes the piston to move in opposition to the spring force, thus opening the plunger tip 22 relative to the passage 79.

Turning to FIG. 4, a cross-sectional view of an exemplary embodiment of the second valve assembly 8 is provided. As shown, the second valve assembly 8 has a first (upper) cylindrical body portion 32, a second (lower) cylindrical body portion 39, a caplike body portion 88 that caps off the first body portion at one end (the upper end of the valve assembly), and an internal piston 34 slidably contained within the first body portion. The first and second cylindrical body portions 32 and 39 are welded to one another along a weld seam 95. Further as shown, the inlet port 35 and outlet port 37 of the valve assembly 8 extend outward from opposite sides of the first cylindrical body portion 32, in directions substantially transverse to a central axis 97 of body portions 32 and 39. Also as shown, in the present embodiment, the outlet port 37 is at a higher position, closer to the upper end of the valve assembly, than is the inlet port 35.

In at least some embodiments, the body portions 32, 39 and piston 34 are injection molded with a thermoplastic material, for example, various forms of PA including PA-6 and PA-66 (e.g., Zytel® nylon available from E.I. du Pont de Nemours and Company of Wilmington, Del., or Gelon® A100 nylon available from the General Electric Company of Fairfield, Conn.), PPA (e.g., Amodel® polyphthalamide available from Solvay Advanced Polymers, L.L.C. of Alpharetta, Ga.), PC+PBT (e.g., Xenoy® resins also available from GE), or PPS thermoplastic material. The caplike body portion 88 can in some embodiments be a Metalok Bantam plastic industrial circular connector (e.g., as available from Souriau USA of York, Pa.). Depending upon the material that is used, various degrees of fuel vapor permeation rates can be achieved.

Additionally as shown, the piston 34 has an upper portion 96 having a greater diameter substantially equaling the inner diameter of the first cylindrical body portion 32, a lower portion 99 having a relatively lesser diameter equaling the inner diameter of the second cylindrical body portion 39, and an intermediate portion 69 having largely an hour-glass shape that at its maximum points (e.g., at the opposite ends) has only the lesser diameter of the lower portion 99. Also, in the present embodiment, the piston 34 is molded around a vapor control valve piston actuation rod 36, which can be made from steel or other suitable material, and which extends through the body portions 32, 39 along the central axis 97. The rod 36, which can be used to govern movement of the piston 34, can be influenced both along a top end 61 extending outward past the caplike body portion 88 and also along a bottom end 63 extending outward from the valve assembly from its lower end opposite the caplike body portion.

Further, two grooves are also formed around the exterior of the piston 34, which serve to support two (upper and lower) sealing O-rings 38, which can be made from fluorosilicone rubber material (e.g., made from Viton® flouroelastomer also available from du Pont). In the present embodiment, the upper one of the O-rings 38 (the O-ring closer to the caplike body portion 88) is positioned proximate the upper end of the piston 34 (again, the end that is closer to the body portion 88) and has at least a 5 psi minimum design rating, while the lower one of the two O-rings is positioned proximate the lower end of the piston 34 and has at least a 10 psi minimum design rating. Further, the second valve assembly 8 includes a piston return spring 40, which can be made from any suitable material including but not limited to stainless steel (or possibly other metallic materials).

In addition to the O-rings 38, the piston 34 along an annular lower rim 64 of the upper portion 96 also includes a washer seal 68 (e.g., again made from Viton® flouroelastomer and having at least a 10 psi minimum design rating). Movement of the piston 34 within the body portions 32, 39 is restricted insofar as the upper portion 96 is precluded from traveling downward within the first cylindrical body portion 32 beyond an annular ridge 74 that extends inwardly at approximately the same level as the upper edge of the input port 35 and the lower edge of the output port 37. When the piston 34 moves sufficiently downward within the valve assembly 8, the washer seal 68 on the upper portion 96 encounters the ridge 74 and forms a seal therewith.

Operation of the valve assembly 8 proceeds as follows. When the handle 16 (see FIG. 2) is in the "off" position, the piston return spring 40 tends to cause the piston 34 to move away from the caplike body portion 88 so that the seal is formed by the combination of the washer seal 68 and the ridge 74. When the piston 34 is in this position, the piston tends to prevent fluid flow from the input port 35 of the valve assembly 8 to its output port 37, such that the valve assembly is in its normal, non-venting position. Additionally, due to interfacing of the upper and lower O-rings 38 with the first and second cylindrical body portions 32 and 39, respectively, fluid flow between the input and output ports 35, 37 and either end of the valve assembly 8 is also precluded.

Although normally the handle 16 is in the "off" position and the valve assembly 8 (due to the operation of the spring 40) is in a closed position such as that shown in FIG. 4, the valve assembly 8 also can be opened as follows. At the bottom end 63 of the actuation rod 36 is a hook 67 (or orifice or other coupling structure) by which the handle 16 is attached to the rod 36. As the handle 16 is moved upward toward the valve assembly to the "on" position, the piston 34 is moved upward contrary to the force of the spring 40. As a result, the seal between the washer seal 68 and ridge 74 is first broken. Subsequently the intermediate portion 69 of the piston 34 is moved to extend between the input port 35 and the output 37. Thus, an annular channel is formed between the intermediate portion 69 and the inner surface of the first cylindrical body portion 32 linking the input and output ports 35, 37, which enables fuel vapor to proceed from the carburetor, fuel bowl and the fuel tank into the airbox.

As alluded to above, force applied to the top end 61 of the rod 36, for example by way of a system control cable 66 (see FIG. 1) can also influence operation of the second valve assembly 8, for example, by affecting a system state dependency. Also, in at least some embodiments, the air cleaner base is located at the top of the carburetor. The vapor control valve body 32 is attached directly to the inboard side of the air cleaner base (not shown) and vents directly into the induction air stream of the engine when the engine is either in the start or run mode. When the engine is in the off mode, fuel vapor is not allowed to vent into the engine or escape to the surrounding environment.

Figure 5:
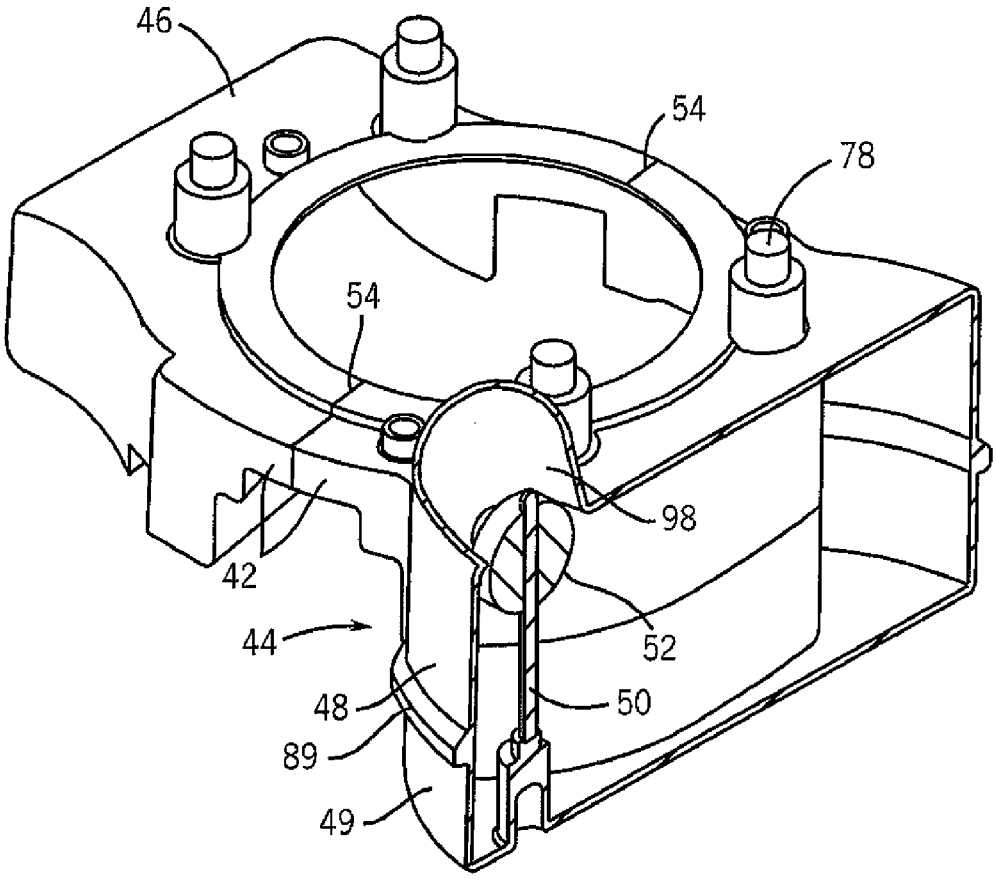
FIG. 5 is a schematic, partially cross-sectional diagram of a fuel tank employed in the evaporative emission control system of FIG. 1.

Referring to FIG. 5, that figure depicts a partial cross-sectional cutaway view of an exemplary unified fuel tank and blower housing 42 as can be employed in the system 1 in at least some embodiments. A fuel tank portion 44 of the unified fuel tank and blower housing 42 is molded from low permeation material including but not limited to polyphthalamide (PPA) and polyphenylene sulfide (PPS). A blower housing portion 46 of the unified fuel tank and blower housing 42 can also be molded of low permeation material, including but not limited to PPA and PPS, or alternatively can be made from a less expensive material, including but not limited to glass filled polypropylene. The portions 44 and 46 are welded together along a weld line 54.

Further as shown, fuel tank portion 44 is composed of two body portions 48 and 49 that are welded together at a weld line 89. The upper body portion 48 of the tank portion 44 contains mounting features 78 for the complete assembly of the unified fuel tank and blower housing 42 to the engine. The lower body portion 49 of the tank 44 contains additional devices. For instance, the lower body portion 49 of the fuel tank 44 supports a shaft 50 along which a fuel float 52 can travel up or down depending on fuel volume. In at least some embodiments, the float mechanism can be constructed from two hemispheres and provide three functions: (1) to indicate a full fuel level condition, achieved with visual feed back from the upper float hemisphere; (2) to serve as a fuel restricting device and prevent fuel from entering the tank quickly, by partially sealing itself at the filler neck (e.g., as is necessary when an over full condition results from filling the tank quickly); and (3) to allow for the slow release of a fuel stabilizing chemical agent. The chemical agent can be added to the interior of the lower hemisphere of the float, slowly dissolving when in contact with fuel over a predetermined time. The chemical agent can be added in any suitable form including but not limited to liquid, a gel, or a solid. In at least some embodiments, the chemical agent is added as a gel or a solid. The chemical agent can be any agent that stabilizes fuel including but not limited to STA-BIL, Store Safe Fuel Stabilizer or Neutra Fuel Stabilizer.

The fuel tank portion 44 also includes a neck 98 to which can be coupled a fuel tank filler cap such as the cap 13 of FIG. 1. The fuel tank filler cap is made from low permeation materials as discussed above and in at least some embodiments includes the following features: (1) a tethering strap so the cap remains with the assembly, which prevents the cap from being misplaced; (2) a tactile latching sound or feel so as to indicate when the cap is in a fully tight and sealed position; and (3) a depressurizing mechanism so liquid fuel is not dispelled from the tank under certain conditions as the cap is removed from the filler neck. In this respect, additional vapor pressure in the tank is vented to the atmosphere during partial opening of the fuel filler cap. Although not shown in FIG. 5, the fuel tank portion 44 also includes a vapor exit port by which the fuel tank portion is coupled to the vapor hose 10 (such exit port is formed on the section of the fuel tank portion that has been cutaway in FIG. 5) and thus to the second valve assembly 8 (see FIG. 1).

In at least some embodiments, the present invention additionally relates to a method to prime the engine with fuel for cold engine starting. More particularly, as discussed above, when the handle 16 is moved toward the "on" position, the second valve assembly 8 is opened allowing fuel vapors and excess pressure buildup within the fuel tank 12, fuel bowl 4 and fuel tank vapor hose 10 to be discharged to the airbox and the engine intake. The release of this pressure can serve to "prime" the engine.

The present invention is intended to be applicable to a wide variety of different types of engines, and in particular is not limited to single-cylinder engines. For example, embodiments of the present invention can be used in two-cylinder, four-cylinder or other multi-cylinder engines. Further, while the above-described embodiments primarily relate to a system of mechanical components to prevent evaporation or hydrocarbon leakage of fuel to the environment, in other embodiments, other types of evaporative emissions could also be prevented or reduced. Additionally, it is intended that the present invention also encompass embodiments in which there is variation of the individual components of the first and second valve assemblies but the first and second valve assemblies continue to function in the manner recited herein or in a similar manner. It should further be understood that the terms used herein to suggest relative positioning of different components (e.g., the use of the terms "upper" and "lower" in relation to the components of the valve assembly 8 of FIG. 4) are used for convenience herein and that, notwithstanding the use of these terms, the present invention is not intended to be limited to embodiments having such positioning of components relative to one another or relative to any particular reference point (e.g., the "upper" portions of the valve assembly 8 need not necessarily be positioned at a higher level relative to the ground than the "lower" portions of the valve assembly).

It is specifically intended that the present invention not be limited to the embodiments and illustrations contained herein, but include modified forms of those embodiments including portions of the embodiments and combinations of elements of different embodiments as come within the scope of the following claims.

I claim:

1. An emission control apparatus for an engine, comprising:

(a) a first valve assembly that regulates a first flow of fuel from a fuel bowl into a carburetor;

(b) a second valve assembly that regulates a second flow of fuel vapors from a fuel bowl and a fuel tank into a region upstream of an engine cylinder, wherein when the engine is off, the fuel vapors are trapped by the second valve assembly and not by a canister; and (c) an actuator that controls opening and closing of said first valve assembly and said second valve assembly.

2. The emission control apparatus of claim 1, wherein when closed said second valve assembly reduces an amount of fuel vapors that are able to escape from at least one of the carburetor and the fuel tank into the atmosphere.

3. The emission control apparatus of claim 1, wherein when closed said first valve assembly reduces an amount of fuel vapors that develop within the carburetor.

4. The emission control apparatus of claim 1, wherein the actuator is one of an operator-actuatable handle and a motor-driven actuator.

5. The emission control apparatus of claim 4, wherein the actuator is the operator-actuatable handle, and wherein movement of the operator-actuatable handle also governs an on/off status of an engine on which is mounted the emission control apparatus.

6. The emission control apparatus of claim 1, wherein the actuator, first valve assembly and second valve assembly are configured so that movement of the actuator causes opening of the first and second valve assemblies in a staggered manner.

7. The emission control apparatus of claim 1, wherein initial movement of the actuator causes first opening of the second valve assembly so as to allow the second flow of the fuel vapors to proceed into an airbox, prior to a second opening of the first valve assembly.

8. The emission control apparatus of claim 1, further comprising a fuel tank.

9. The emission control apparatus of claim 8, wherein a fuel float is located within said fuel tank.

10. The emission control apparatus of claim 9, wherein said fuel float comprises a fuel stabilizing agent that can take a gel or solid form.

11. The emission control apparatus of claim 1, wherein at least one of the valve assemblies includes a housing, an internal piston, and a spring for biasing the internal piston in relation to the housing.

12. The emission control apparatus of claim 1, wherein the second valve assembly comprises:

a housing defining an interior cavity and having an input port and an output port at respectively different locations along an axis of the housing, wherein the housing includes a first ridge extending inwardly into the cavity from an inner surface of the housing;

a piston capable of sliding movement within the cavity along at least a portion of the inner surface of the housing, wherein the piston includes a second ridge extending outwardly from at least one outer surface of the piston; and means for sealing mounted on at least one of the first and second ridges, wherein the means for sealing substantially precludes air flow between the input and output ports when the piston is moved along the axis so that the first and second ridges contact one another at least indirectly by way of the means for sealing.

13. An engine, comprising:

(a) a carburetor;

(b) a fuel bowl supported in relation to the carburetor;

(c) a fuel tank coupled to the fuel bowl;

(d) a first valve assembly, wherein said first valve assembly comprises an input port, an output port, and a passageway that when opened links the input and output ports, wherein the input port is coupled to said fuel tank and said fuel bowl to receive vapors therefrom and the vapors received from both the fuel tank and the fuel bowl proceed from the input port to the output port when the passageway is opened;

(e) a second valve assembly, wherein said second valve assembly regulates a flow of fuel from said fuel bowl into said carburetor; and (f) an actuator coupled at least indirectly to each of the first and second valve assemblies, whereby opening and closing of said passageway of said first valve assembly and said second valve assembly is regulated; and wherein the engine does not include a vapor absorbing canister.

14. The engine of claim 13, wherein a hose structure is used to couple said input port to upper regions of each of said fuel tank and said fuel bowl to receive the vapors.

15. The engine of claim 14, further comprising an engine fuel supply line, wherein said supply line couples a lower region of the fuel tank to the fuel bowl.

16. The engine of claim 15, wherein a fuel float is located within said fuel tank.

17. The engine of claim 16, wherein said fuel float comprises a fuel stabilizing agent.

18. The engine of claim 13, wherein when the passageway of the first valve assembly is opened, at least some of the vapors received at the input port are allowed to pass to the output port of the first valve assembly and subsequently to a location upstream of an engine cylinder of the engine.

19. The engine of claim 18, wherein the output port is coupled to at least one of an air filter housing, a blower housing, an airbox and an intake manifold.

20. The engine of claim 13, wherein the actuator is one of an operator-actuated handle and an automated actuator.

21. The engine of claim 13, wherein the engine is at least one of a v-twin engine and a small off-road engine.

22. A method for reducing emissions from an engine, the method comprising:

providing an assembly including a fuel tank, a carburetor, a fuel bowl coupled to the fuel tank and the carburetor, a first valve assembly coupling the fuel bowl with the carburetor and governing a first flow of fuel from the fuel bowl to the carburetor, and a second valve assembly coupling the fuel vapors of both the fuel tank and the fuel bowl to a region upstream of a cylinder, wherein the assembly does not include a vapor absorbing canister;

opening the second valve assembly to allow a first flow of fuel vapors from both the fuel bowl and fuel tank into the region; and subsequently opening the first valve assembly to allow a second flow of fuel from the fuel bowl into the carburetor.

23. The method of claim 22, wherein when the first and second valve assemblies are both closed, evaporative emissions from the carburetor, the fuel bowl and the fuel tank are substantially prevented.

24. The method of claim 23, wherein when the first and second valve assemblies are both closed, a rapidity with which the fuel within the fuel tank becomes stale is reduced.

25. The method of claim 22, wherein the opening of said first valve assembly and second valve assembly is achieved by means for actuating.

26. The method of claim 25, further comprising starting an operation of the engine when the means for actuating moves so as to cause the opening of the valve assemblies.

27. The method of claim 22, wherein the opening of said first valve assembly and second valve assembly is performed in an intermittent manner.

28. An emission control apparatus for an engine, comprising:

(a) a first valve assembly that regulates a flow of fuel vapors from both a fuel bowl and a fuel tank into a region upstream of an engine cylinder, wherein when the engine is off, the fuel vapors are trapped by the first valve assembly and not by a canister; and (b) an actuator that controls a first opening and closing of said first valve assembly.

29. The apparatus of claim 28, further comprising a second valve assembly that regulates a movement of fuel from a fuel bowl into a carburetor.

30. The apparatus of claim 28, wherein the actuator controls a second opening and closing of the second valve assembly in addition to controlling the first opening and closing of the first valve assembly, and wherein the actuator causes the second valve assembly to open only after the first valve assembly has been opened.

* * * * *